US008187998B2

(12) United States Patent
Lindemann et al.

(10) Patent No.: US 8,187,998 B2
(45) Date of Patent: May 29, 2012

(54) DOCUMENT AND METHOD OF MANUFACTURING A DOCUMENT

(75) Inventors: Horst J. Lindemann, Buchholz (DE); Samuel Schindler, Drestedt (DE)

(73) Assignee: U-NICA Technology AG, Malans (CH)

( * ) Notice: Subject to any disclaimer, the term of this patent is extended or adjusted under 35 U.S.C. 154(b) by 606 days.

(21) Appl. No.: 12/354,475

(22) Filed: Jan. 15, 2009

(65) Prior Publication Data

US 2009/0181261 A1 Jul. 16, 2009

(30) Foreign Application Priority Data

Jan. 16, 2008 (DE) ..... 10 2008 005 136

(51) Int. Cl.
*B41M 5/30* (2006.01)

(52) U.S. Cl. ..... 503/201; 503/218; 503/226

(58) Field of Classification Search ..... None
See application file for complete search history.

(56) References Cited

U.S. PATENT DOCUMENTS

| | | | | |
|---|---|---|---|---|
| 6,440,898 | B1 * | 8/2002 | Kranz | 503/215 |
| 6,616,964 | B1 * | 9/2003 | Hampp et al. | 427/7 |
| 2005/0024955 | A1 | 2/2005 | Brosow | |

FOREIGN PATENT DOCUMENTS

| | | | |
|---|---|---|---|
| DE | 199 14 702 | A1 | 10/2000 |
| DE | 19961841 | A1 | 6/2001 |

OTHER PUBLICATIONS

European Search Report corresponding to European Patent Application No. 09405005.1, dated Jul. 15, 2010.
N. Hampp, et al. "Multifunctional Optical Security Features Based on Bacteriorhodopsin", XP-002584224, pp. 117-124, May 2004.

* cited by examiner

*Primary Examiner* — Bruce H Hess
(74) *Attorney, Agent, or Firm* — Sughrue Mion, PLLC

(57) ABSTRACT

A document has a carrier layer and at least a functional layer. The functional layer is provided with a content of bacteriorhodopsin as color pigment and, when the document is printed generating an essentially irreversible color change in the area of the bacteriorhodopsin by a supply of energy.

12 Claims, 1 Drawing Sheet

DOCUMENT AND METHOD OF MANUFACTURING A DOCUMENT

BACKGROUND OF THE INVENTION

1. Field of the Invention

The present invention relates to a document with a carrier layer and at least one functional layer.

The invention also relates to a method for manufacturing a document in which at least one functional layer is fixed on a carrier layer.

2. Description of the Related Art

Documents of this type may be, for example, in the form of travel tickets or admission tickets. These documents are frequently provided with a thermofunctional layer which is marked by the use of a thermoprinter. Such thermo layers are frequently used without protective cover layers which leads to the result that the blackening generated by the thermoprinter can be removed once again by using solvents. For example, many hair sprays contain appropriate solvents.

After removing the original print, the document can be provided with a new print by a counterfeiter. Such counterfeits frequently occur in connection with travel tickets or admission tickets.

SUMMARY OF THE INVENTION

It is the primary object of the present invention to provide a document of the above-described type with an increased protection against counterfeiting.

In accordance with the invention, this object is met by providing the functional layer with bacteriorhodopsin as a color pigment.

Another object of the present invention is to improve a method of the above-identified type in such a way that the manufactured document has an increased protection against counterfeiting.

In accordance with the present invention, the functional layer is provided with a content of bacteriorhodopsin as a color pigment and, when printing the document, an essentially irreversible color change is generated by supplying energy in the area of the bacteriorhodopsin.

Bacteriorhodopsin is a biological color pigment. It is especially a photochromic retinal protein. The bacteriorhodopsin is highly optimized with respect to the intended use and shows a light induced, high-contrast and reversible color change between violet and yellow or other color combinations. This color change is easily recognized by an observer.

Another optical behavior of the bacteriorhodopsin is created when this color pigment is radiated not only with normal ambient light, but also with coherent light, particularly laser light. Such an irradiation leads to an irreversible color change which does not change again after the irradiation or illumination has been concluded.

In accordance with the invention, it has been recognized that this irreversible color change is not created by the type of irradiation, but by the energy supply to the color pigments which is created by the coherent light. 'When printing on thermopaper or other thermosensitive coatings, a thermoprinting head which has a surface temperature of about 180° C. to 200° C. is used. The corresponding heat energy penetrates into the material to be printed and generates a temperature gradient with a temperature which decreases in the direction toward the material interior. The bacteriorhodopsin exhibits its irreversible color change at a temperature influence in the range of about 140° C., so that, when the color pigment is arranged at a sufficiently small distance from the surface acted upon by the thermohead, such a temperature of influence can be achieved.

It is particularly possible to maintain the concentration of the bacteriorhodopsin in the functional layer in such a small percentage that the respective coloring cannot be visually observed by an observer. Only an appropriate measuring apparatus can make the coloration visible. This avoids undesirable color changes of the document.

A simple printing of the document is achieved by constructing the functional layer as a thermofunctional layer.

An improved functional capability is achieved by arranging at least two functional layers one above the other.

The fact that the functional layer arranged so as to face away from the carrier layer contributes to a simple manipulation.

A small necessary penetration depth of the energy applied is reinforced by arranging the color pigment in the upper functional layer.

An arrangement of the color pigments which is protected relative to the outer influences and unauthorized observation is achieved by arranging the color pigments in the lower functional layer.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

Figure 1:
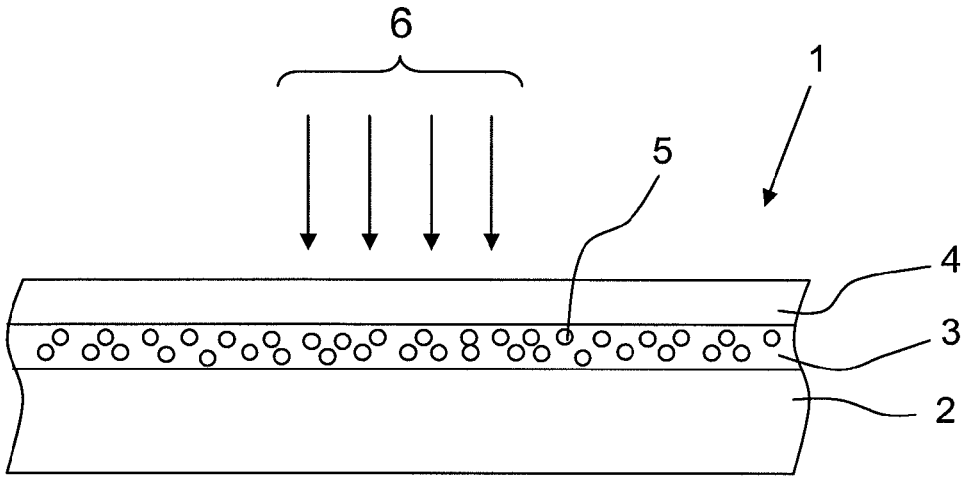
Figure 2:
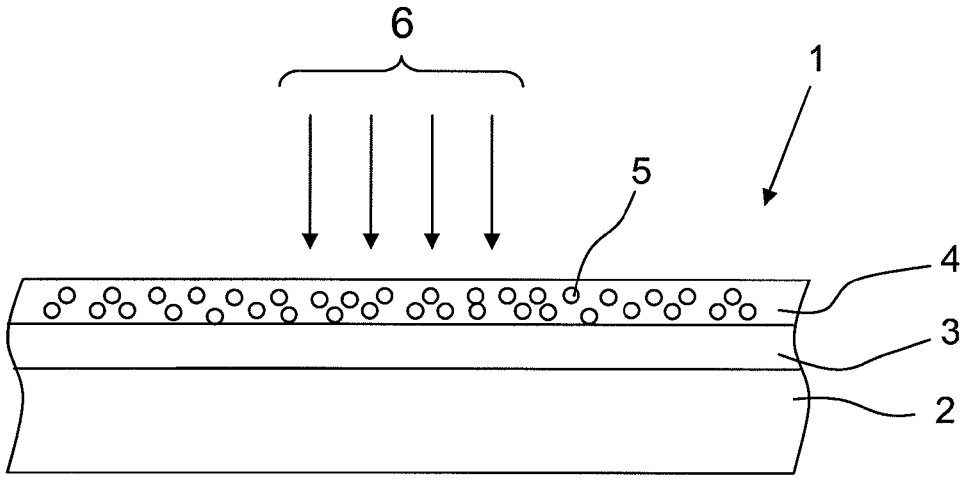

IN THE DRAWING:

FIG. 1 is a schematic cross-sectional view of a document with an arrangement of bacteriorhodopsin as the color pigment in a lower functional layer, and FIG. 2 shows an arrangement modified as compared to FIG. 1, with a use of bacteriorhodopsin within an upper thermolayer.

DETAILED DESCRIPTION OF THE INVENTION

FIG. 1 shows a partial illustration of a cross-section of a document 1 which includes a carrier layer 2. A lower functional layer 3 and an upper functional layer 4 are arranged on the carrier layer. The lower functional layer 3 is located between the upper functional layer 4 and the carrier layer 2.

It is particularly advantageous to construct the carrier layer 2 as the base paper and the lower functional layer 3 as a preliminary application which improves the adherence of the upper functional layer 4 to the carrier layer 3. The upper functional layer 4 is typically constructed as a thermolayer.

In accordance with the embodiment of FIG. 1, a color pigment 5 is arranged in the area of the lower functional layer 3, wherein the color pigment 4 bacteriorhodopsin In accordance with the embodiment of FIG. 2, the color pigment 5 is arranged in the area of the upper functional layer 4. Also in this case, the color pigment 5 is bacteriorhodopsin.

It is basically possible, as an alternative to bacteriorhodopsin, to use other retinal proteins as the biological color pigments.

With respect to the manufacturing technology, the carrier layer 2 is over its entire width provided with the functional layers 3, 4.

Printing of the upper functional layer 4 takes place with the use of a conventional thermohead. This thermohead produces in the area of the upper functional layer 4 a blackening as it is known from the state of the art. In addition, the color of the color pigment arranged in the area of the lower functional layer 3 and/or the upper functional layer 4 is changed irreversibly. Even in the case of a subsequent removal of the print on the thermolayer and a replacement of this original imprint by a counterfeit imprint, the original print remains detectible by the irreversible color change of the color pigment. By using suitable reading devices which detect the color change of the color pigment through the thermolayer, such counterfeits can be recognized and the counterfeit documents 1 can be confiscated.

While specific embodiments of the invention have been shown and described in detail to illustrate the inventive principles, it will be understood that the invention may be embodied otherwise without departing from such principles.

The invention claimed is:

1. A document comprising:

a carrier layer; and at least a first functional layer, the first functional layer being a thermosensitive layer such that printing of the document with a thermal print head causes a blackening in the first functional layer, the first functional layer further comprising bacteriorhodopsin as a color pigment, such that heat generated by printing of the document with said thermal print head further causes at least some of the bacteriorhodopsin in the first functional layer to irreversibly change its color.

2. The document according to claim 1, wherein the bacteriorhodopsin in the first functional layer is present in a concentration which is sufficiently low to cause a coloring of said document which is invisible to the naked human eye.

3. A method for manufacturing a document, the method comprising:

fixing at least a first functional layer to a carrier layer, the first functional layer being a thermosensitive layer which additionally comprises bacteriorhodopsin, and printing the document with a thermal print head so as to cause a blackening in the first functional layer and to further cause at least some of the bacteriorhodopsin in the first functional layer to irreversibly change its color due to heat generated by said thermal print head.

4. The method according to claim 3, further comprising measuring a coloring caused by the bacteriorhodopsin in the first functional layer with a measuring apparatus.

5. A document comprising:

a carrier layer, a first functional layer, the first functional layer being a thermosensitive layer such that printing of the document with a thermal print head causes a blackening in the first functional layer; and a second functional layer comprising bacteriorhodopsin as a color pigment such that heat generated by printing of the document with said thermal print head additionally causes at least some of the bacteriorhodopsin in the second functional layer to irreversibly change its color.

6. The document according to claim 5, wherein the second functional layer is arranged between the carrier layer and the first functional layer.

7. The document according to claim 5, wherein the first functional layer is arranged between the carrier layer and the second functional layer.

8. The document according to claim 5, wherein the bacteriorhodopsin in the second functional layer is present in a concentration which is sufficiently low to cause a coloring of said document which is invisible to the naked human eye.

9. A method for manufacturing a document, the method comprising:

fixing a first and a second functional layer to a carrier layer, the first functional layer being a thermosensitive layer and the second functional layer comprising bacteriorhodopsin as a color pigment; and printing the document with a thermal print head so as to cause a blackening in the first functional layer and to further cause at least some of the bacteriorhodopsin in the second functional layer to irreversibly change its color due to heat generated by said thermal print head.

10. The method according to claim 9, wherein the second functional layer is arranged between the carrier layer and the first functional layer.

11. The method according to claim 9, wherein the first functional layer is arranged between the carrier layer and the second functional layer.

12. The method according to claim 9, further comprising measuring a coloring caused by the bacteriorhodospin in the second functional layer with a measuring apparatus.

* * * * *